United States Patent [19]

Nishino

[11] Patent Number: 4,913,079

[45] Date of Patent: Apr. 3, 1990

[54] YACHT

[75] Inventor: Yoshinori Nishino, Yamatotakada, Japan

[73] Assignee: Nippon Basic Technology Laboratory Co., Ltd., Japan

[21] Appl. No.: 269,798

[22] Filed: Nov. 10, 1988

[51] Int. Cl.[4] ..... B63B 3/26

[52] U.S. Cl. ..... 114/357; 114/89; 114/355; 114/39.1; 440/54

[58] Field of Search ..... 114/357, 126, 140, 83, 114/39.1, 355; 441/74; 440/54

[56] References Cited

U.S. PATENT DOCUMENTS

| | | | |
|---|---|---|---|
| 2,858,788 | 11/1958 | Cyman | 114/126 |
| 3,747,550 | 7/1973 | Stoeberl | 114/140 |
| 3,807,347 | 4/1974 | Baldwin | 440/54 |
| 4,365,580 | 12/1982 | Blount | 114/357 |
| 4,471,710 | 9/1984 | Brown | 114/357 |
| 4,679,522 | 7/1987 | Nishida | 114/357 |

FOREIGN PATENT DOCUMENTS

| | | | |
|---|---|---|---|
| 702464 | 1/1965 | Canada | 114/357 |
| 2602376 | 7/1977 | Fed. Rep. of Germany | 441/74 |

*Primary Examiner*—Sherman D. Basinger
*Assistant Examiner*—Thomas J. Brahan
*Attorney, Agent, or Firm*—Barnes, Kisselle, Raisch, Choate, Whittemore & Hulbert

[57] ABSTRACT

The invention relates to a yacht. The yacht has a body, and this body comprises at least outer and inner skins formed of a resin material incorporating reinforcement fibers therein, and a formed styrol material as a foamed synthetic resin member filled between the skin layers. Therefore, the body is resistant to compression force, tensile force, and bending force, and well withstands the impact force of waves. By use of these materials, the yacht is inexpensive to construct and is lightweight so that good improvement in speed can be obtained.

3 Claims, 11 Drawing Sheets

7
3
4
61
θ

YACHT

FIELD OF THE INVENTION

This invention relates to yachts.

BACKGROUND OF THE INVENTION

In a conventional yacht, its body has a rigid hull structure constructed of wood, fiber reinforced concrete resin, and the like.

According to such conventional construction, the body has a rigid hull structure protected against breakage due to the impact force of waves. This naturally involves high cost of construction. Further, the body is heavy, which is a limiting factor in respect of speed.

SUMMARY OF THE INVENTION

In view of the foregoing problem, this invention has as its object the provision of a yacht having sufficient strength and light in weight.

In order to accomplish this object, the invention, in its first aspect, provides a yacht having a body, said body comprising an outer skin and an inner skin, both skins being formed of a resin material incorporating reinforcement fibers therein, bonding foamed material layers laminated on the inner surfaces of the skins, and a main foamed material filled between the bonding foamed material layers.

According to such construction, the body is highly rigid against compression force, tensile force, and bending force, and sufficiently resistant to the impact force of waves. Further, the body is inexpensive to construct and lightweight. The lightweight construction provides good improvement in speed. Another advantage is that the bonding foamed material layers permit strong bond between the skins and the main foamed material. The main foamed material provides improved resistance to seawater. Furthermore, the carbonic acid gas present in the main foamed material as a residue from the foaming process serves to prevent the body from expansion and thus to reduce possible fatigue of the body.

In its second aspect, the invention provides a yacht having a body, said body comprising an outer skin and an inner skin, both skins being formed of a resin material incorporating reinforcement fibers therein, half-ring plate shaped reinforcement plate means disposed between the two skins, and a foamed synthetic resin material filled between the skins, said reinforcement plate comprising rigid members positioned on two upper ends of the reinforcement plate, a pair of resin-made thin layers having reinforcement fibers put over and extending from the rigid members and incorporated therein, and a foamed synthetic resin material filled between the resin-made thin layers, said rigid members having a rope securing fitment fixed thereto.

According to such construction, the body is constructed of a fiber reinforced resin material and a formed synthetic resin material and, therefore, it is rigid against compression force, tensile force, and bending force and is highly resistant to the impact force of waves. Further, because of these materials, the body is inexpensive to construct and lightweight. The lightweight construction provides good improvement in speed. In addition, the reinforcement plate provides considerable improvement in hull strength, with no much increase in body weight. More particularly, the reinforcement plate serves to diffuse stress if the reinforcement fibers set to the rigid members are widely distributed in the transverse directions, so that the rope securing fitment can be stably and securely fixed in position.

DESCRIPTION OF THE PREFERRED EMBODIMENTS

Figure 1:
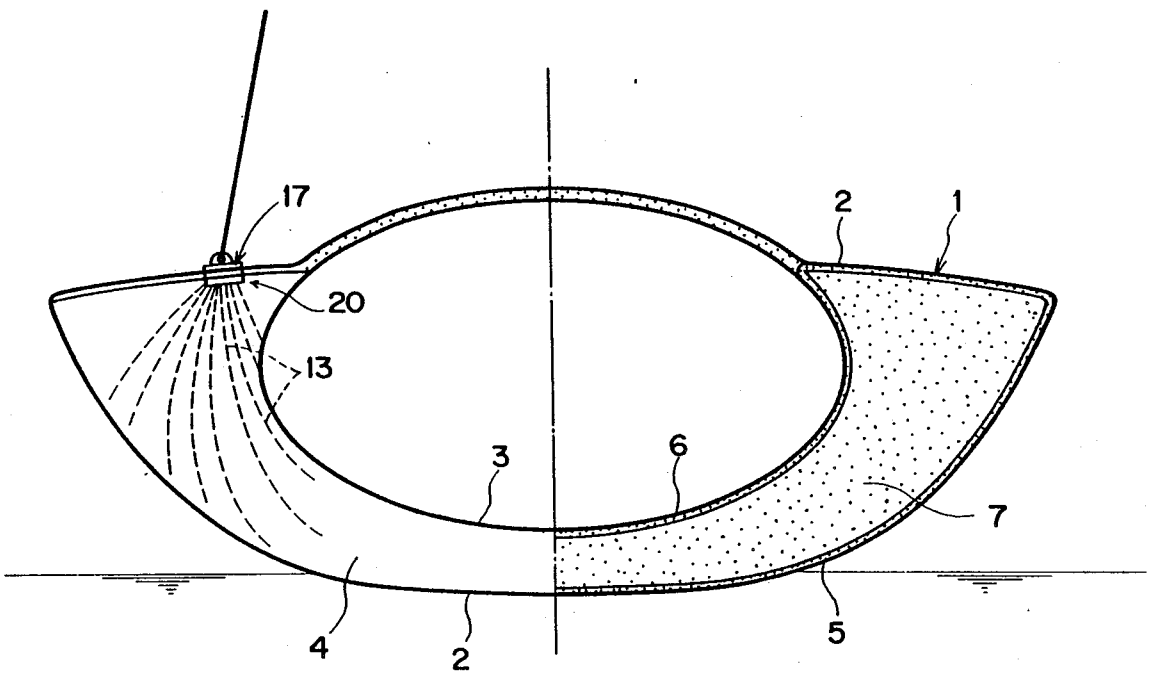
FIG. 1 is a cross sectional view showing one embodiment of the yacht according to the invention.
Figure 2:
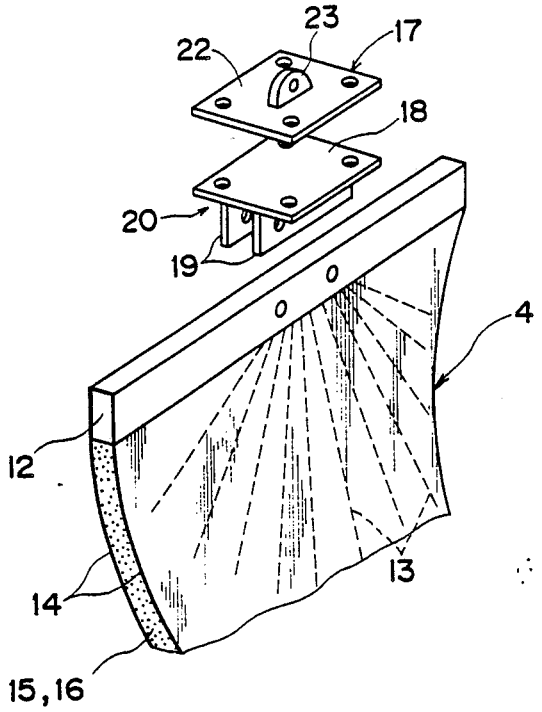
FIG. 2 is an enlarged perspective view showing a reinforcement plate in FIG. 1.
Figure 3:
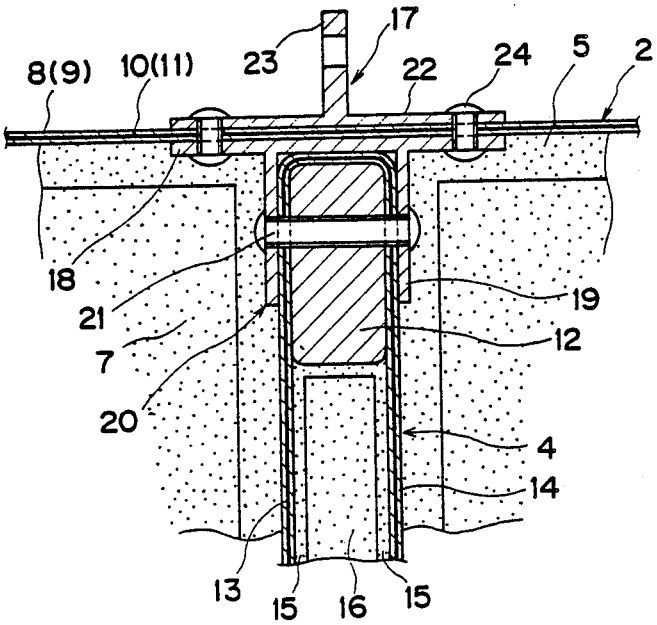
FIG. 3 is a sectional view showing principal portions of the reinforcement plate in FIG. 2.

In FIGS. 1 through 4, a body 1 comprises an outer skin 2 and an inner skin 3, both skins having a thickness of approximately 1 to 2 mm, a half-ring plate shaped reinforcement plate or plates 4 disposed between the two skins 2, 3 at one location or a plurality of locations in the longitudinal directions of the body 1, foamed urethane layers 5, 6 laminated on the inner surfaces of the skins 2, 3, and a formed styrol material 7 filled between the foamed urethane layers 5, 6. The skins 2, 3 incorporate therein carbon fibers (used as reinforcement fibers, by way of example, which may be glass fibers) 10, 11.

The reinforcement plate 4 comprises a rigid member 12 of square bar shape positioned at two upper ends of the plate 4, a pair of resin-made thin layers 14 incorporating therein a multiplicity of carbon fiber filaments (used as reinforcement fibers) 13 put over and extending from the rigid member 12, foamed urethane layers 15 laminated on the inner surfaces of the thin resin layers 14, and a foamed styrol material filled between the foamed urethane layers 15. The carbon fiber filaments 13 are widely spread in the transverse directions of the body 1.

A rope securing fitment 17 is fixed to the rigid member 12 of the reinforcement plate 4. A connecting fitment 20 comprising an abutment plate 18 and a pair of downwardly extending brackets 19 is fitted on the rigid member 12 from above through the downwardly extending brackets 19, the rigid member 12 and the brackets 19 being integrally fixed by a fixing member 21. The abutment plate 18 of the connecting fitment 20 is in abutment with the inner surface (underside) of a portion of the outer skin 2 which corresponds to an upper deck. An abutment plate 22 of the rope securing fitment 17 which comprises the abutment plate 22 and a rope securing portion 23 is in abutment with the outer surface (upperside) of the outer skin 2 in opposed relation to the abutment plate 18. The abutment plates 18, 22 are integrally fixed together by a fixing member 24, with the corresponding portion of the outer skin 2 therebetween.

Numeral 25 designates a cabin provided on the upper rear surface of the body 1, numeral 26 designates a resin made fin keel incorporating reinforcement fibers therein, 27 designates a mast, 28 designates a boom, 30 designates a main sail, 31 designates a jib sail, 33 designates a ladder, 35 designates a forestay, 36 designates a backstay, and 37 designates a shroud.

Operation of the above described arrangement will now be described. Normally, with both the main sail 30 and the jib sail 31 unfurled, the yacht sails under wind. Since the foamed styrol 7 is resistant to compression, and the skins 2, 3 incorporating carbon fibers therein are resistant to tensile force and bending force, the body 1 can sufficiently withstand pitching and rolling. The rope securing fitment 17 to which the shroud 37 is fixed is connected to the reinforcement plate 4 through the connecting fitment 20 and the like. Since the reinforcement plate 4, by virtue of the carbon fibers 13 incorporated therein, operates to diffuse stress in the transverse directions, the rope securing fitment 17 is stably and firmly fixed to the body 1 and can well withstand the tensile force of the shroud 37. The skins 2, 3 and the foamed syrol 7 are in close and strong bond relation by virtue of the foamed urethane 5, 6. The foamed styrol 7 provides improved resistance to seawater. Furthermore, the carbonic acid gas present in the foamed styrol as a residue from the foaming process serves to prevent the body 1 from expansion. The body 1 is lightweight and has improved capability in respect of speed.

Figure 4:
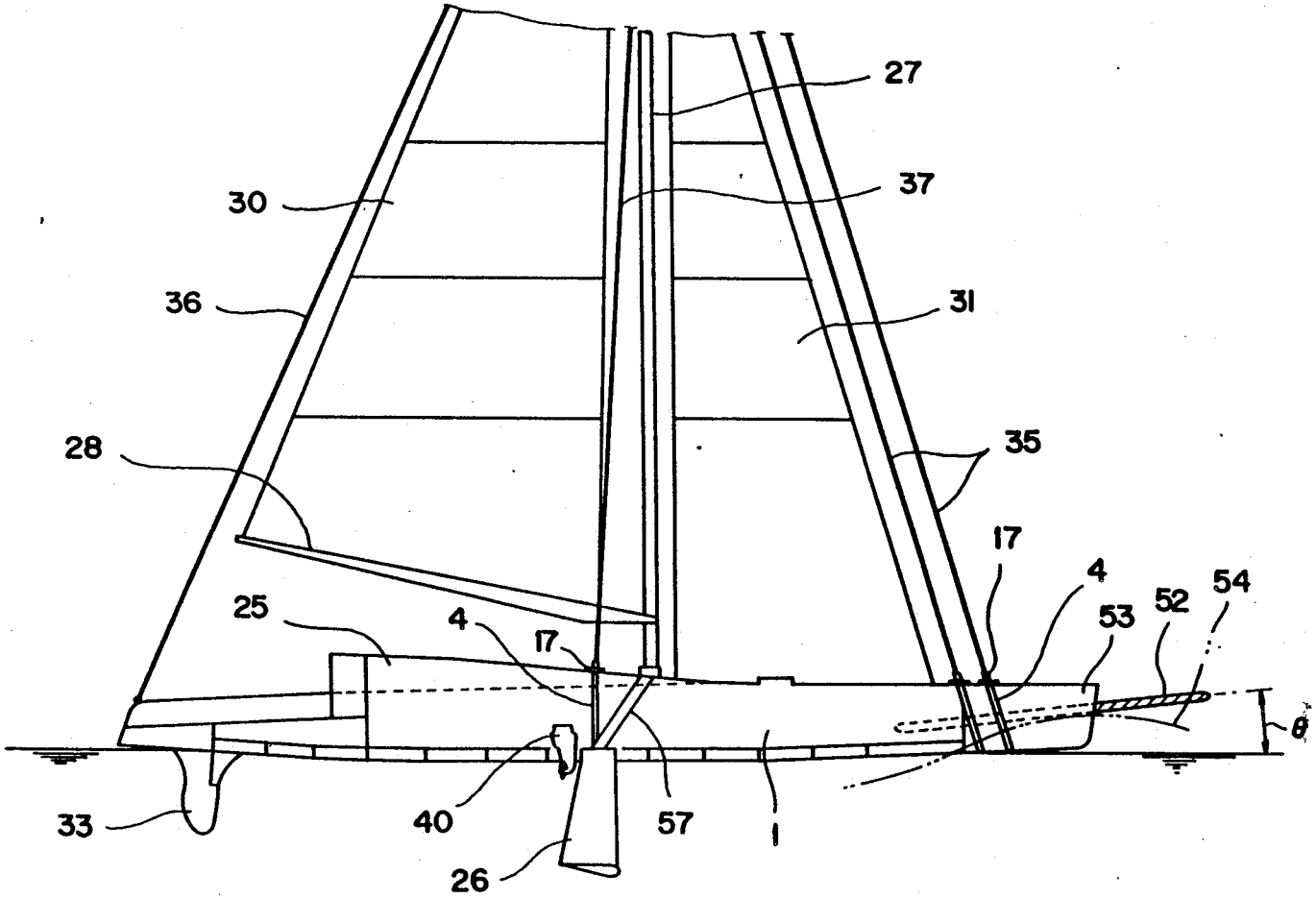
FIG. 4 is a side view of the yacht shown in FIG. 1.

When no wind is available, the main sail 30 and the jib sail 31 and lowered and an engine 40 shown in FIG. 4 is got into the water for self sailing.

Figure 5:
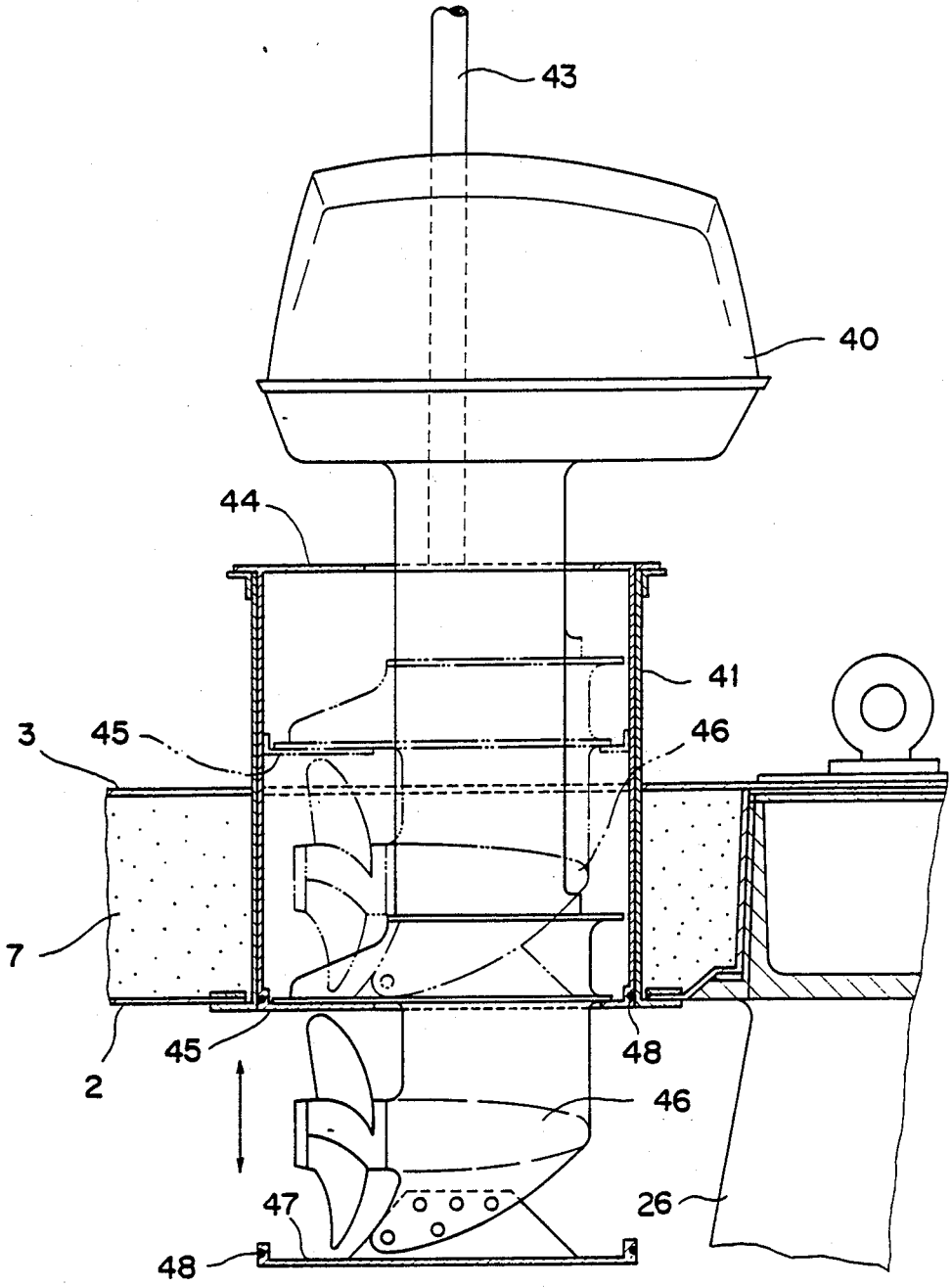
FIG. 5 is a detailed view in side elevation of an engine in FIG. 4.
Figure 6:
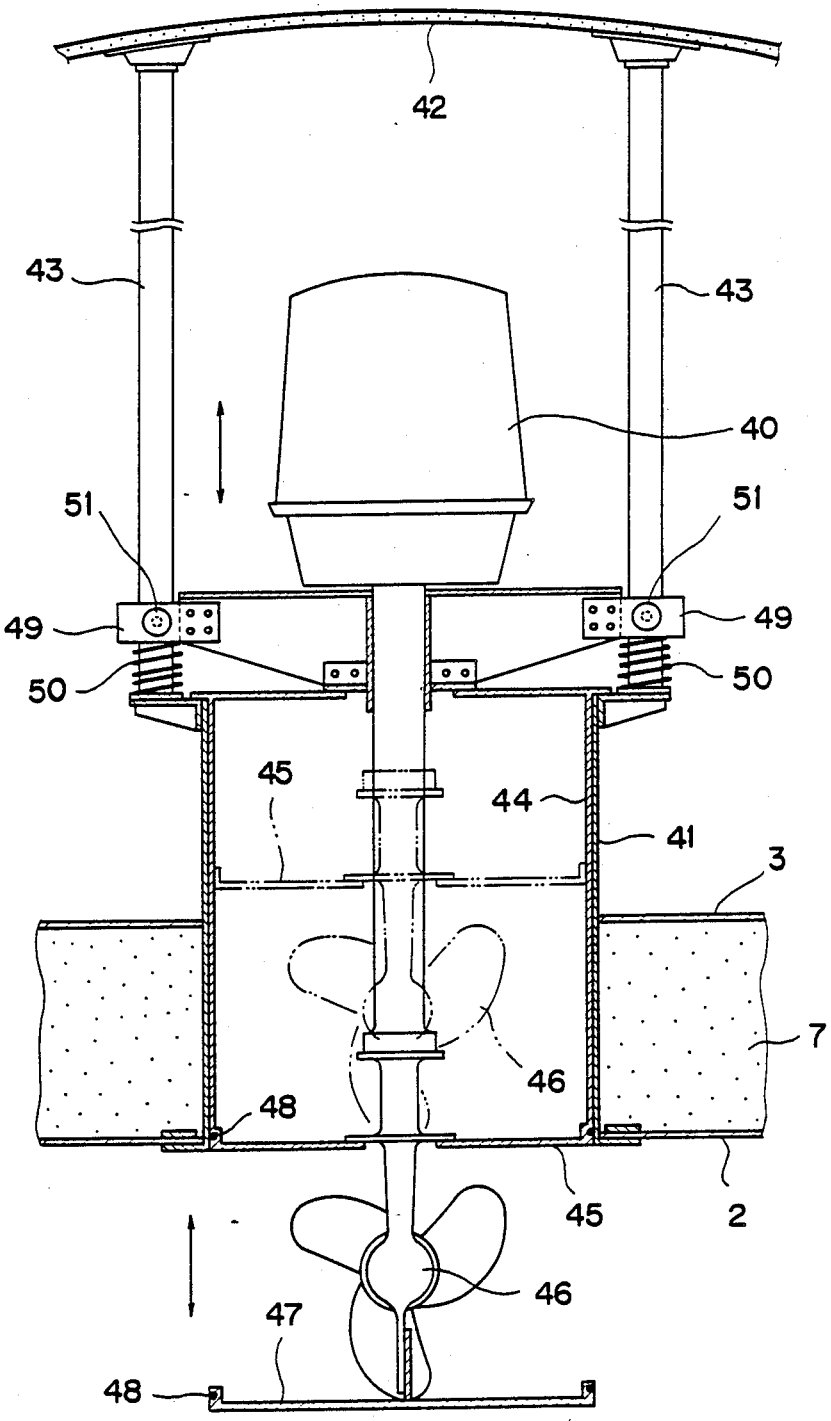
FIG. 6 is a front view of the engine shown in FIG. 5.

FIGS. 5 and 6 show in detail mounting arrangement for the engine 40. Numeral 41 designates a cylindrical frame extending upward through the bottom of the yacht, the cylindrical frame 41 being open at the upper and lower ends thereof. A pair of guide bars 43 extend vertically between the cylindrical frame 41 and an inboard ceiling 42. Inside the cylindrical frame 41 there is disposed a second cylindrical frame 44 which is slidable vertically along the inner surface of the cylindrical frame 41. The engine 40, which employs an outboard engine, is mounted to the cylindrical frame 44 in such a way that it extends through a bottom plate 45 of the cylindrical frame 44, its screw portion 46 being positioned below the bottom plate 45. A cover plate 47 which can close the lower opening of the cylindrical frame 41 is provided at a position below the screw portion 46 of the engine 40. Seal members 48 are provided around both the cover plate 47 and the bottom plate 45.

At top side of the second cylindrical frame 44 there are disposed bosses 49 which receive lower ends of the guide bars 43. Shown by 50 are springs provided around the guide bars 43, which springs 50 urge the bosses 49 upward to provide a biasing force to lift the cylindrical frame 44 and the engine 40 toward the inboard side. Each of the bosses 49 is provided with a set screw 51 for fixing it to the corresponding guide bar 43.

With such arrangement as above described, when the engine 40 is to be got into the water as mentioned above, the engine 40 and the cylindrical frame 44 are pushed down manually or otherwise against the force of the springs 50 so as to thrust the screw portion 46 into the water, and when the bottom plate 45 is at a position level with the bottom of the hull, the set screws 51 are manipulated to fix the engine 40 in position. In FIGS. 5 and 6, the relevant parts put in position in such case are shown by solid lines.

When the engine 40 is to be retracted toward the inboard side, the set screws 51 are loosened and the engine 40, together with the cylindrical frame 44, is lifted with the aid of the force of the springs 50. When the cover plate 47 reaches a position even with the bottom of the hull, the engine 40 is fixed in position by the screws 51. Thus, the yacht is now ready for sailing without being subject to water resistance due to the screw portion 46 projecting outward from the hull. In FIGS. 5 and 6, the relevant parts as they appear in such case are shown in phantom lines.

Figure 7:
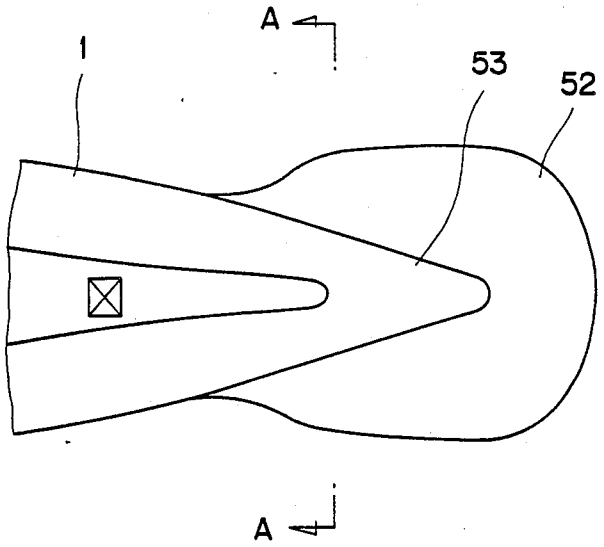
FIG. 7 is a plan view showing a canade in FIG. 4.
Figure 8:
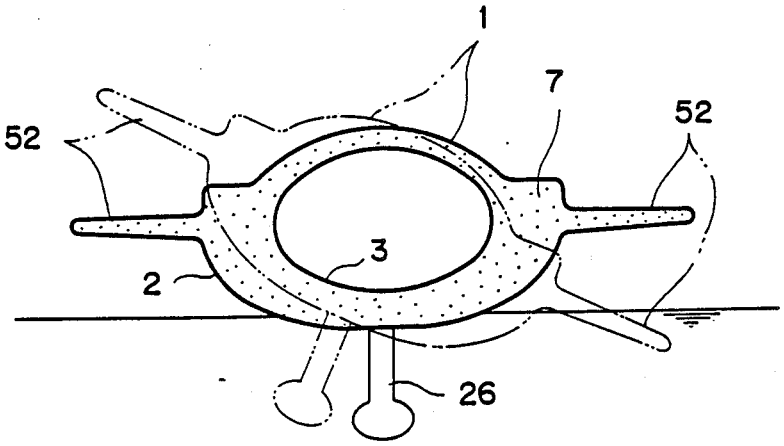
FIG. 8 is a section taken on line A—A in FIG. 7.

As can be seen from FIG. 4, the stem portion of the body 1 is formed with a canard 52 as a part of the hull, which canard 52 is also shown in FIGS. 7 and 8. The canard 52 is in the form of a fin which is preferably wing-shaped in section. As shown, the canard 52 projects laterally of the stem 53 of the hull within a dimensional range of not longer than the width of the hull and also projects forwardly of the stem 53. The rear portion of the canard 52 extends to a position at which it is not likely to be struck by side waves during calm sailing. Further, as FIG. 4 shows, the canard 52 is upwardly inclined. Shown by Θ is the pitch angle with respect to the inclination.

The provision of such upwardly inclined canard 52 offers various advantages. When there are waves 54 as shown in FIG. 4, or when the body 1 is in the state of pitching, the canades 52 are washed by the waves. This prevents the stem 53 from plunging into the water. Another advantage is that air resistance that acts on the canard 52 will inhibit pitching. In case where there is considerable rolling as shown by phantom line in FIG. 8, the canard 52 will dip into the water and the resulting buoyancy develops a lift force serving as a ballast.

Figure 9:
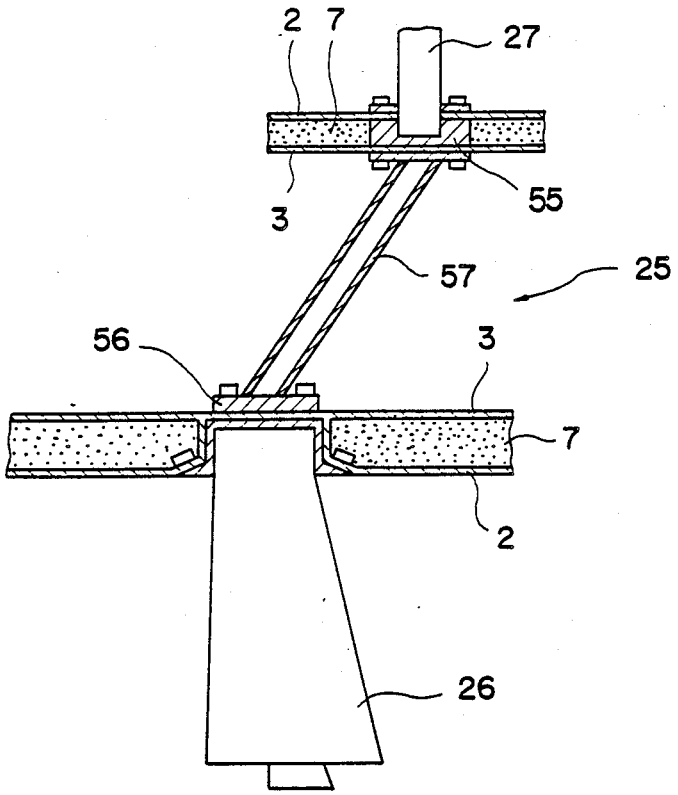
FIG. 9 is a side view showing in detail a reinforcing support between a mast and a fin keel in FIG. 4.

As FIG. 9 shows in detail, there is provided a reinforcing support 57 extending obliquely between a mount 55 for the mast 27 and a mount 56 for the fin keel 26 in the cabin 25.

Figures 10A, 10B, 10C:
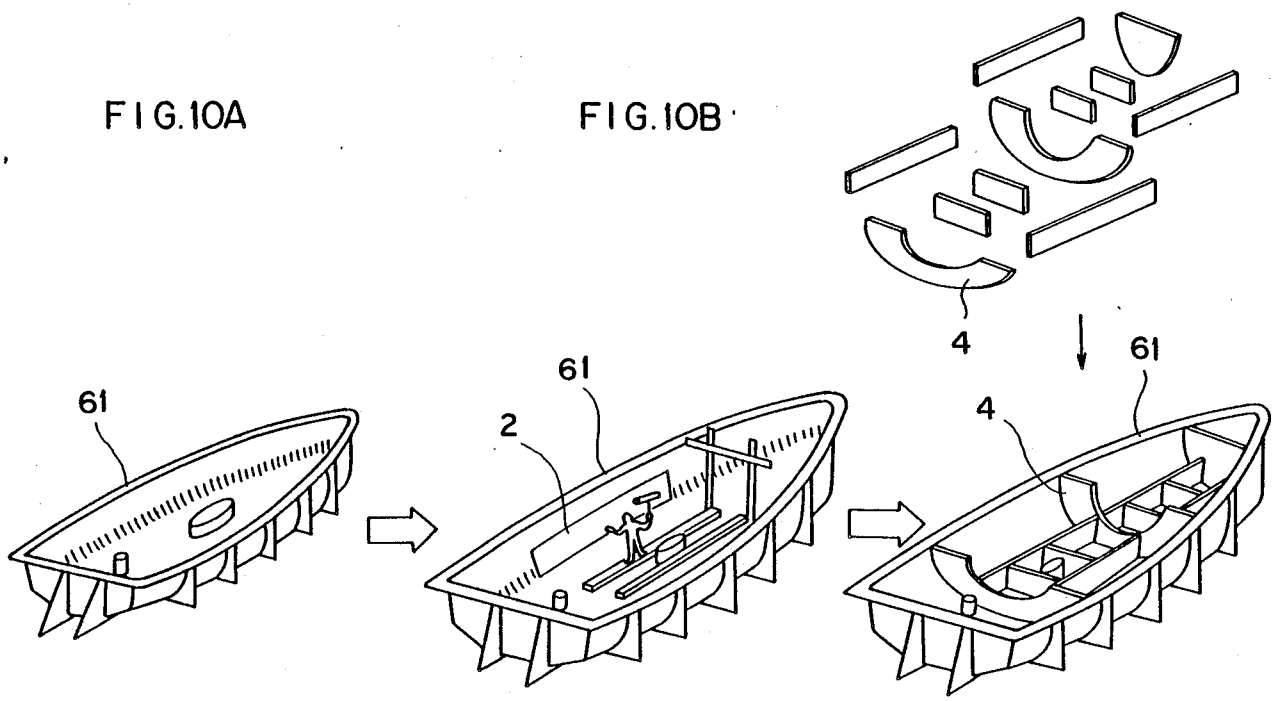
FIGS. 10A through 10L are views illustrating various stages in the process of constructing the yacht according to the invention.
Figures 10D, 10E, 10F:
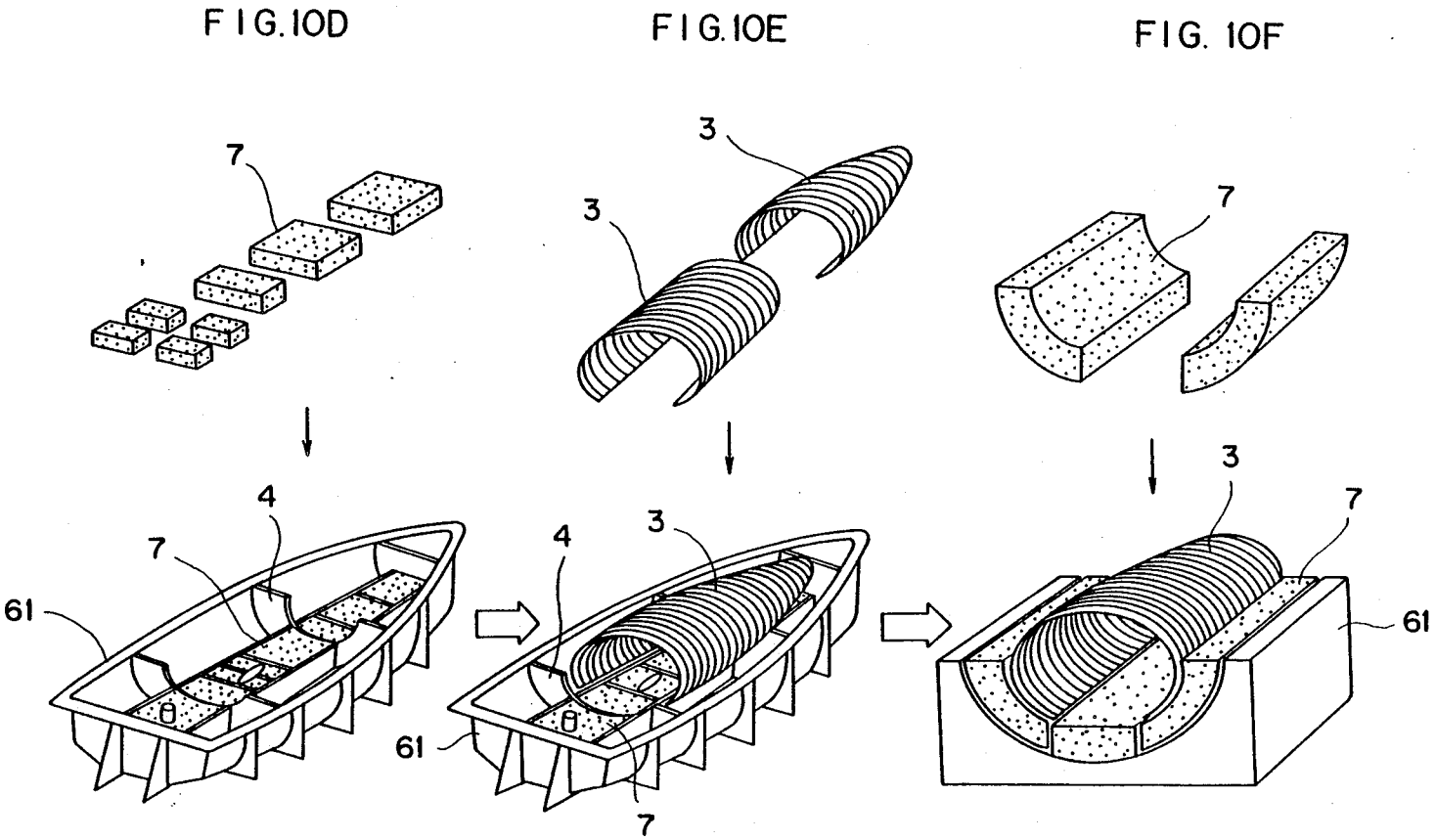
Figure 10G:
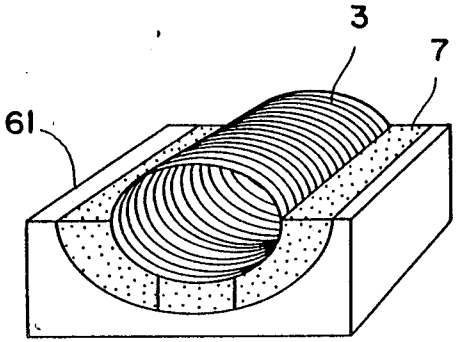
Figure 10H:
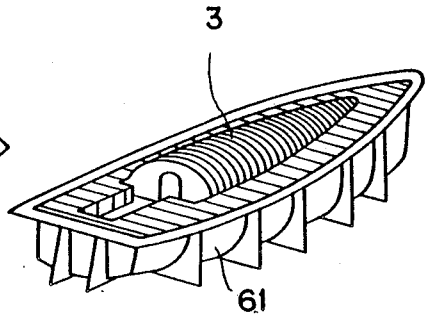
Figure 10I:
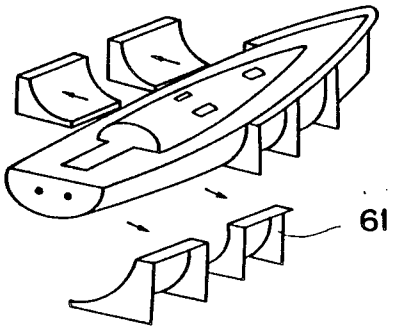
Figure 10L:
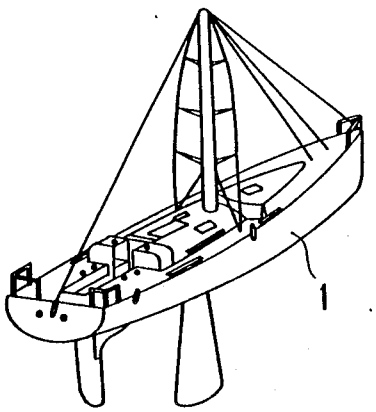
Figure 10K:
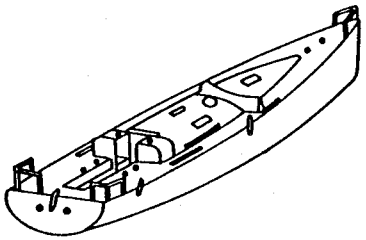
Figure 10J:
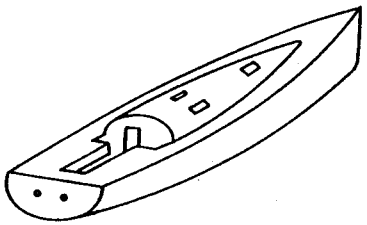

FIGS. 10A through 10L illustrate various stages involved in the process of constructing the yacht according to the invention. In FIG. 10A, a male mold 61 is prepared, and in FIG. 10B an outer skin 2 for the hull is formed. Then, at the FIG. 10C stage, reinforcement plate 4 and the like are mounted in position; and at the FIG. 10D stage, a blocked foamed material 7 for the hull bottom is mounted. At the FIG. 10E stage, an upper portion of the inner skin 3 is mounted. At the FIG. 10F stage, a blocked foamed material 7 for hull sides is mounted. At the FIG. 10G stage, a lower portion of the inner skin 3 is mounted, and at the FIG. 10H stage, lamination work for the deck and a canopy is carried out. At the FIG. 10I stage, the mold is disassembled. Then, at the FIG. 10J stage, coating work is performed. Subsequently, at the FIG. 10K stage, various outfit works are carried out. Thus, construction of the yacht is completed as it appears in FIG. 10L.

What is claimed is:

1. A yacht having a body, said body comprising an outer skin and an inner skin, both skins being formed of a resin material incorporating reinforcement fibers therein, half-ring plate shaped reinforcement plate means disposed between the two skins, and a foamed synthetic resin material filled between the skins, said reinforcement plate comprising rigid members positioned on two upper ends of the reinforcement plate means, a pair of resin-made thin layers having reinforcement fibers put over and extending from the rigid members and incorporated therein, and a foamed synthetic resin material filled between the resin-made thin layers, said rigid members having a rope securing fitment fixed thereto.

2. A yacht as set forth in claim 1, further comprising a unit having a screw and an engine, the unit being position-changeable between a position at which the unit projects from the hull bottom into the water and a position at which the unit is completely housed inboard.

3. A yacht as set forth in claim 1, wherein there is provided an upwardly inclined canard at the stem portion of the yacht.

* * * * *